US005901675A

United States Patent [19]

Nakagomi

[11] Patent Number: 5,901,675

[45] Date of Patent: May 11, 1999

[54] VALVE OPERATING APPARATUS OF DOHC

[75] Inventor: Akira Nakagomi, Fujisawa, Japan

[73] Assignee: Isuzu Motors Ltd., Tokyo, Japan

[21] Appl. No.: 09/009,938

[22] Filed: Jan. 21, 1998

[30] Foreign Application Priority Data

Jan. 21, 1997 [JP] Japan ..... 9-008842

[51] Int. Cl.[6] ..... F01L 1/04

[52] U.S. Cl. ..... 123/90.27; 123/90.31; 123/90.6

[58] Field of Search ..... 123/90.27, 90.31, 123/90.6; 74/567

[56] References Cited

U.S. PATENT DOCUMENTS

| | | | |
|---|---|---|---|
| 4,823,747 | 4/1989 | Wagner et al. | 123/90.27 |
| 5,181,485 | 1/1993 | Hirose et al. | 123/90.31 |
| 5,735,239 | 4/1998 | Sugano et al. | 123/90.31 |

*Primary Examiner*—Wellun Lo

*Attorney, Agent, or Firm*—Staas & Halsey

[57] ABSTRACT

A valve operating apparatus for DOHC engine allowing to improve the fuel consumption, in DOHC engines, is provided with by reducing the weight of the shaft system of valve operating mechanism and lowering the driving force for the dynamic valve and, at the same time, permitting to improve the durability and the silence of the transmission system and, moreover, assuring a good combustion even for engines having smaller bore diameter. A first and a second cam shafts for opening/closing the intake/exhaust valve are arranged side by side on a cylinder head, a first transmission means is disposed at a shaft end of the first cam shaft positioned at one side of the engine and, at the same time, shaft ends of the first and second cam shafts located at the other side of the engine are linked for the transmission of the driving power by a second transmission means. And the driving power from a crank shaft is transmitted to the first transmission means, and moreover, the shaft diameter of the second cam shaft is formed smaller than that of the first cam shaft.

1 Claim, 3 Drawing Sheets

VALVE OPERATING APPARATUS OF DOHC

BACKGROUND AND SUMMARY OF THE INVENTION

The present invention relates to a valve operating apparatus of the DOHC engine used for automobile or the like.

In the valve operating mechanism for opening and closing the intake/exhaust valves of an engine, a DOHC direct acting method is known, wherein two cam shafts for driving respectively the intake valve and the exhaust valve are disposed on a cylinder head and tappets on the head of the intake/exhaust valves are directly pressed by a cam to open/close the intake/exhaust valves.

As for the valve operating mechanism of DOHC method, in a valve operating apparatus proposed in the Japanese Patent Publication No. HEI 5-17362, among two cam shafts on a cylinder head, at one face side of an engine, the motive power from a crank shaft is transmitted to one end of a first cam shaft by means of belt or the like and, at the same time, at the other face side,the other end of this first cam shaft and one end of a second cam shaft are interlocked and linked by gears, to transmit the power from the first cam shaft to the second cam shaft.

On the other hand, a rotational driving force applied from the crank shaft acts on these cam shafts, in opposition to the reaction from valve spring or others of the intake/exhaust valves. As a consequence, the cam shaft should be a shaft diameter thickened to provide a rigidity sufficient for preventing deformation such as torsion or flexion or the like under said rotational driving force.

Now, in the interlocking type valve operating apparatus proposed in said Publication, as a stronger rotational driving force acts on the first cam shaft to which the power of the crank shaft is transmitted directly, the first cam shaft should be formed with a shaft diameter having sufficient thickness to resist such a strong rotational driving force.

In the interlocking type valve operating apparatus of said Publication, the diameters of the first cam shaft and the second cam shaft being identical, the shaft diameter of the second shaft and bearings supporting the same would become unnecessary dimension.

As a result, friction or rotation inertia moment of the whole cam shaft system increases, energy consumption increases in rotational transmission system, moreover, when this rotational transmission is ensured by timing belt or timing chain, the tension of these transmission means increases as much and reduces their durability, and additionally, when it is assured by a timing gear, the backlash will increase the teeth knocking noise.

On the other hand, in high performance small stroke volume diesel engines, intake mixture flow is increased commonly by reducing the cylinder bore diameter and, at the same time, increasing the cam lift. However, as the cam lift increases, the protrusion of the cam portion increases as much. As the consequence, when the DOHC direct acting method wherein a cam shaft is placed side by side with the cam driving method is adopted, the cam portion of one cam shaft and the cam portion, or the stem portion of the other cam shaft may interfere easily, so their arrangement should avoid such interference.

However, if the interval between cam shafts is increased keeping the inclination of the valve shaft of the intake/exhaust valves in order to prevent such cam interference, the distance between valve disks will also increase. Moreover, as the diameter of the cylinder bore containing the intake/exhaust valves is limited by the engine volume or length, if the distance between valve disks is increased without changing the intake/exhaust valves diameters, the cylinder bore can no more contain the intake/exhaust valves.

As a consequence, to avoid interference of cam portions, the distance between cam shaft centers is increased without increasing the interval between valve portions of the intake/exhaust valves, by increasing the inclination of valve shafts of the intake/exhaust valves and arranging valve shafts in V-form, in place of increasing the distance between valve disks.

However, when the intake/exhaust valves are inclined largely by increasing the inclination of the valve shafts as in the case of this V-form arrangement, the valve portions of the intake/exhaust valves will be disposed inclined on the upper part of the cylinder bore, and the central portions of the arrangement of respective valves form a space convex upward, in a way to increase spaces called dead volume which can not contribute effectively to the combustion. The increase of this dead volume deteriorates the combustion to generate HC or smoke, resulting in the lowering of the engine performance. This will cause a particularly serious problem in case of higher compression ratio diesel engines.

BRIEF SUMMARY OF THE INVENTION

The present invention has been made in order to solve the problems mentioned above, and the object thereof consists in providing a valve operating apparatus for DOHC engine allowing to improve the fuel consumption, in DOHC engines, by reducing the weight of the shaft system of valve operating apparatus and lowering the driving force for the valves, and at the same time improving the durability of the transmission apparatus and reducing noise, moreover permitting to reduce the dead volume for assuring a good combustion in the cylinder for engine having small bore diameter.

In a valve operating apparatus of DOHC engine for achieving the object mentioned above, a valve operating apparatus of DOHC, comprising a first and a second cam shafts for opening/closing an intake valve and an exhaust valve which are disposed in parallel on a cylinder head of an engine, a first transmission means which is disposed at a shaft end of said first cam shaft positioned at one face side of the engine, and a second transmission means which is disposed at shaft ends of said first and second cam shafts located at the other face side of the engine, and by which said first and second cam shafts are linked for the transmission of the driving power, characterized in that the driving power from a crank shaft is transimitted to said first transmission means, and moreover in that the shaft diameter of said second cam shaft is formed smaller than the shaft diameter of said first cam shaft.

According to the present invention, as the shaft diameter of the second cam shaft to which a rotational force is transmitted from the first cam shaft is formed smaller, in the valve operating apparatus of DOHC engine, the weight of the cam shaft system can be reduced and the inertia moment proportional to the fourth power of shaft diameter or friction can be lowered, and moreover, as the torque variation can be reduced, the rotation force (rotation torque) required to drive the cam shaft can be kept small, the energy required for the rotation can be reduced, and the fuel consumption of the engine can be improved. The effect by this shaft diameter reduction is remarkable. For example, if the shaft diameter is reduced by 10%, its weight will be reduced to 81%, and the inertia moment to 65.5%. It goes without saying that,in this case, the cam shaft diameter assures the minimum required for driving the valve mechanism through this cam shaft.

Moreover, as the rotation force required for driving the cam shaft system can be lowered, in case of belt or chain transmission, the tension thereof can be lowered, in such a way to improve the durability of these belt or chain, and other parts engaged therewith, and in case of gear transmission, teeth knocking noise due to backlash can be reduced.

Also, in small diesel engines whose bore diameter is small, the shaft interval distance of cam shafts can be reduced while avoiding the interference between cams, by reducing the shaft diameter of the second cam shaft. As a consequence, by inhabiting the increase of valve shaft slant, the increase of dead volume due to the increase of this valve shaft inclination can be prevented, so that a good combustion efficiency of these small diesel engines can be also assured.

DETAILED DESCRIPTION OF THE INVENTION

Figure 1:
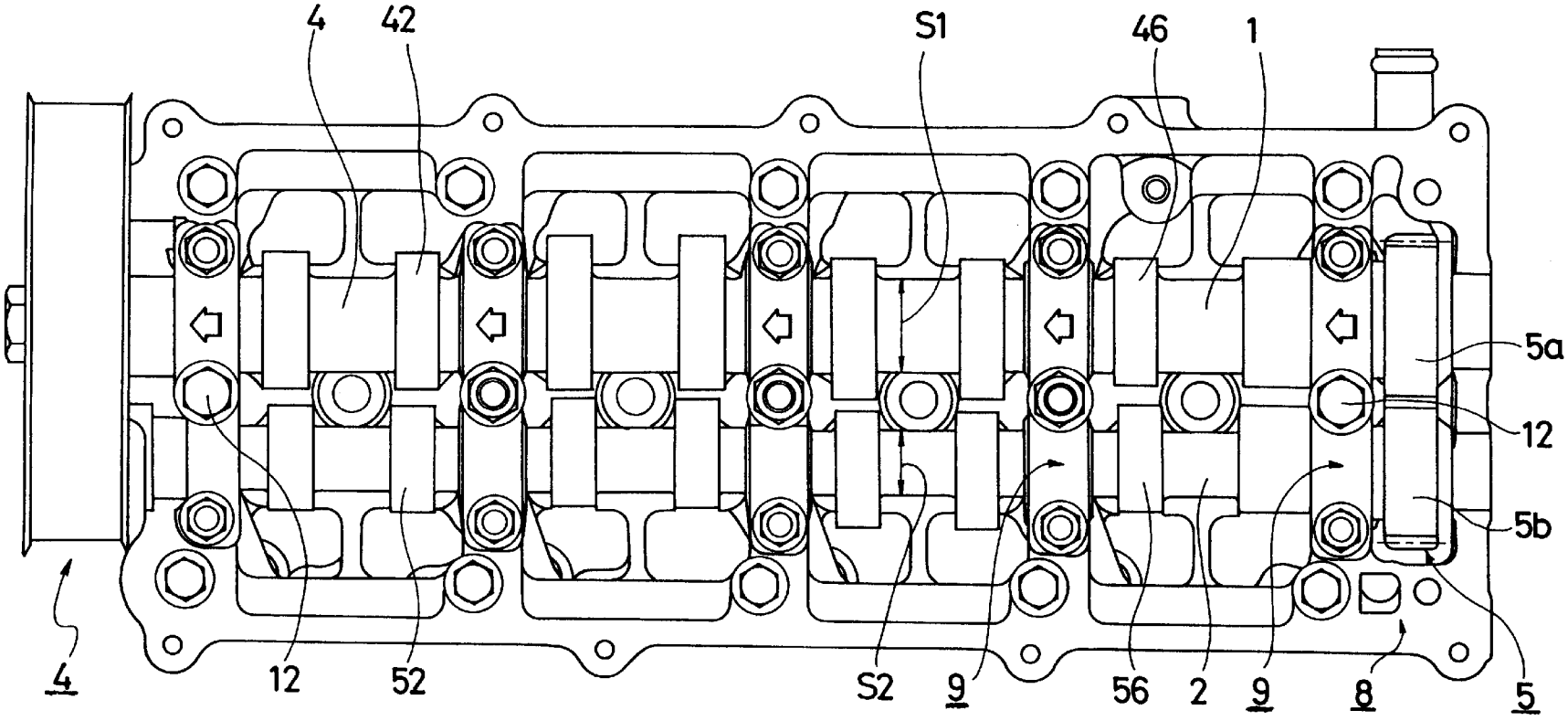
FIG. 1 is a plane view illustrating a valve opearting apparatus according to an embodiment of the present invention.

Now the embodiment of the present invention will be described referring to the drawings.

FIG. 1 is a plane view illustrating a valve operating apparatus of DOHC-engine viewed from above the cylinder, on which a first and a second cam shafts 1,2 are disposed in parallel. A first transmission means 4 for transmitting the rotation force by a timing belt or the like is disposed on one face side, on the front in this example, of the engine and formed to transmit the driving power by a crank shaft not shown. This first transmission means 4 may also be formed by a timing belt or a timing chain or the like, or by a gear such as timing gear.

On the other hand, a second transmission means 5 composed of gears 5*a*, 5*b* or the like for transmitting the rotation force is disposed on the other face side, on the back in this example, and the first and second cam shafts 1,2 are transmission-linked and formed to transmit the rotation force from the first cam shaft 1 to the second cam shaft 2 through the gear 5*a*, 5*b*.

This first cam shaft 1 bears the rotation force transmitted from the crank shaft, the reaction applied from a valve spring 43 or others of the intake valve 40 driven by this cam shaft and, moreover, the moving power for driving the second cam shaft 2; so it is formed with a sufficient shaft diameter S1 providing the rigidity to support them.

The shaft diameter S2 of the second cam shaft 2 is smaller than the shaft diameter S1 of the first cam shaft 1 and formed to be able to transmit the rotation force operating the exhaust valve 50 pushed by a valve spring 53.

These cam shafts 1, 2 are arranged on the shaft support portion of the cam carrier 8 mounted on the cylinder head 3 and, moreover, a cam shaft bracket 9 is disposed for supporting.

Figure 2:
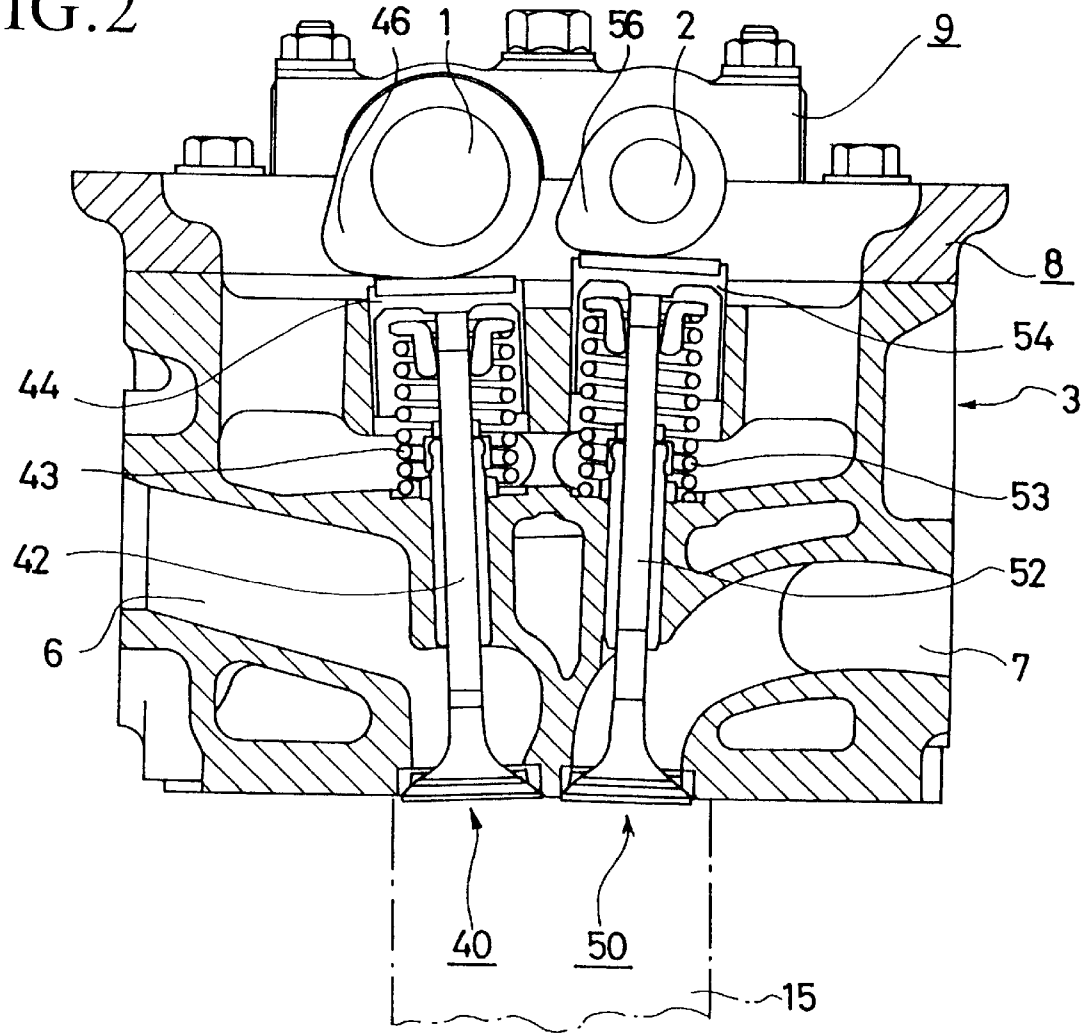
FIG. 2 is a lateral cross-section view illustrating the valve operating apparatus according to the embodiment of the present invention.

As shown in the composition of FIG. 2, a cam 56 of the second cam shaft 2 is also made to correspond to the shaft diameter S2, the base circle diameter thereof is formed smaller than a cam 46 of the first cam shaft 1, and these cams 46, 56 are engaged with tappets 44, 45 on the upper part of the intake valve 40 and the exhaust valve 50 to rise and fall the intake valve 40 and the exhaust valve 50 pushed by the valve springs 43, 53 in the closing direction in the cylinder head 3, for opening/closing an intake port 6 and an exhaust port 7.

In such composition, when the rotation force of the crank shaft is transmitted to the cam shaft 1 through the first transmission means 4, the cam 46 rotates with this cam shaft 1 and pushes down the intake valve 40 through the tappet 48 with a given timing in resistance to the pushing force of the valve spring 43 and opens the intake valve 40, and when the cam 46 rotates further to complete the pushing-down, the pushing force of the valve spring 43 closes the intake valve 40.

Next, when the rotation of the first cam shaft 1 is transmitted to the second cam shaft 2 by the second transmission means 5, the cam 56 rotates with this cam shaft 2, to open/close the exhaust valve 50 with a given timing, as in the case of the intake valve 40.

Here, the first cam shaft 1 opens/closes the intake valve 40 while the second cam shaft 2 opens/closes the exhaust valve 50, however, inversely, it may well also be composed to open/close the exhaust valve 50 with the first cam shaft 1 and the intake valve 40 with the second cam shaft 2. Moreover, the first and the second respective cam shafts may open/close respectively the intake valve 40 and the exhaust valve 50.

By the composition as mentioned above, the following effects can be expected.

The shaft diameter S2 of the second cam shaft can2 is formed smaller to reduce the weight thereof, so the friction and the inertia moment of the cam shaft system can be lowered and, accordingly, the driving force can be kept small and the fuel consumption of the engine can be improved.

Moreover, as the rotation force required for the transmission means 4 between the crank shaft and the first cam shaft 1 decreases in consequence of the reduction of the driving force of the cam shaft system, in case of belt or chain transmission, the tension thereof can be lowered, in such a way to improve their durability.

When the transmission means 4 is composed of timing gear, as the weight, inertia moment and the transmission force of the cam shaft system are reduced, teeth knocking noise due to backlash can be reduced.

Also, when the DOHC direct acting method is adopted for small diesel engines whose bore diameter is small, the shaft interval distance can be reduced, while avoiding the interference with the cam 46 of the first cam shaft 1 by reducing the shaft diameter S2 of the second cam shaft 2 and, consequently, reducing the base circle diameter of the cam 56. As a consequence, the slant of valve shaft 42, 52 can be reduced to reduce dead volume in the cylinder, so that a good combustion efficiency can be attained.

Figure 3:
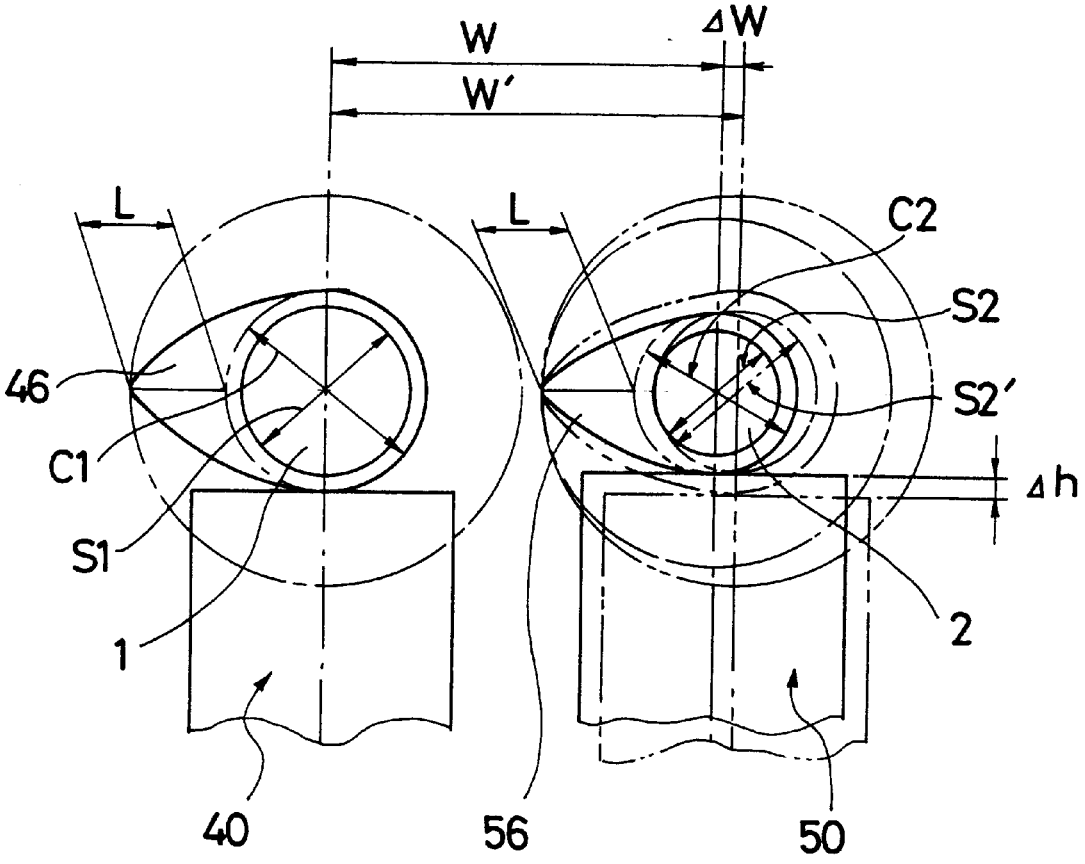
FIG. 3 is a illustration for depicting the relation between the cam shaft diameter and the distance between the shafts.

To sum up, as shown in FIG. 3, by reducing the second cam shaft 2 from the diameter S2' shown by two-dot chain line to the diameter S2 shown by solid line, the shaft interval distance can be reduced from W' to W and the distance can be shortened by $\Delta W=(S1-S2)/2$. In this case, the valve lift amount can be ensured by the cam nose height L, while the reduction (2×Δh) of the cam base circle diameter C2 can be compensated by increasing the height of the valve head by Δh as shown in the drawing, or by decreasing the stem height of the cam shaft 2 by Δh.

What is claimed is:

1. A valve operating apparatus of DOHC, comprising:

a first and a second cam shafts for opening/closing an intake valve and an exhaust valve which are disposed in parallel on a cylinder head of an engine, a first transmission means which is disposed at a shaft end of said first cam shaft positioned at one face side of the engine, and a second transmission means which is disposed at shaft ends of said first and second cam shafts located at the other face side of the engine, and by which said first and second cam shafts are linked for the transmission of the driving power, characterized in that the driving power from a crank shaft is transimitted to said first transmission means, and moreover in that the shaft diameter of said second cam shaft is formed smaller than the shaft diameter of said first cam shaft.

* * * * *